United States Patent [19]

Fuller

[11] 3,947,651

[45] Mar. 30, 1976

[54] ELECTRICAL CARTRIDGE WITH INTERCHANGEABLE CIRCUITRY FOR THE CAP

[75] Inventor: Maurice D. Fuller, Mercer Island, Wash.

[73] Assignee: Korry Manufacturing Company, Seattle, Wash.

[22] Filed: May 13, 1974

[21] Appl. No.: 469,316

Related U.S. Application Data

[62] Division of Ser. No. 266,305, June, 1972.

[52] U.S. Cl. ..... 200/314; 200/280; 200/292

[51] Int. Cl.[2] ..... H01H 9/16

[58] Field of Search ..... 200/292, 281, 280, 314; 310/71

[56] References Cited

UNITED STATES PATENTS

| | | | |
|---|---|---|---|
| 2,321,999 | 6/1943 | Dalton | 339/18 P |
| 3,030,460 | 4/1962 | Huetten et al. | 200/292 X |
| 3,515,835 | 6/1970 | Debras | 200/314 |
| 3,598,948 | 8/1971 | Bowen et al. | 200/292 X |

*Primary Examiner*—Robert K. Schaefer
*Assistant Examiner*—William J. Smith
*Attorney, Agent, or Firm*—Christensen, O'Connor, Garrison & Havelka

[57] ABSTRACT

The cartridge is interchangeably structured to accommodate various servomechanisms for the switch or other operating unit therein, as well as to accommodate various electrical arrangements for the pushbutton cap which is slidably guided in the open end of the cartridge to operate the servomechanism. The cap is releasably latched to each servomechanism by a cross-biased latch mechanism which prevents the cap from being shocked out of the cartridge, but which can nevertheless be overridden by a finger pull on the cap when it is desired to remove the cap from the cartridge. When so removed, the cap is tethered to the cartridge, although the tether is releasable from the cap, and vice versa, should this become necessary or desirable.

3 Claims, 11 Drawing Figures

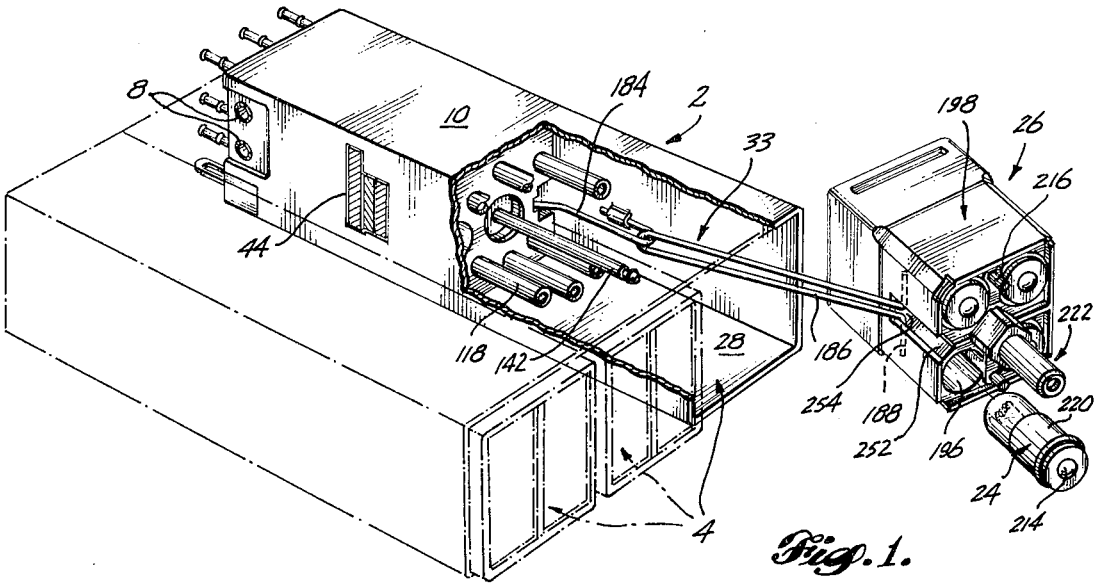
Fig. 1.
Fig. 9.
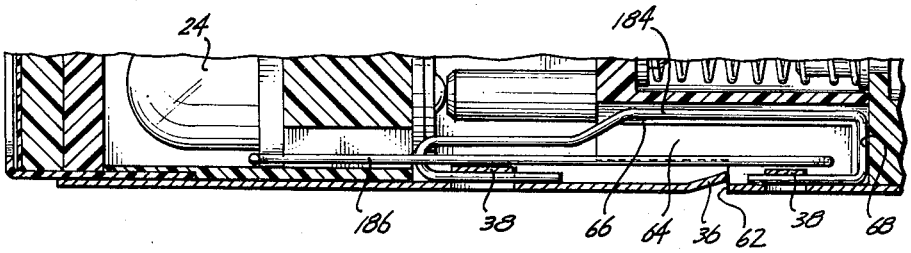
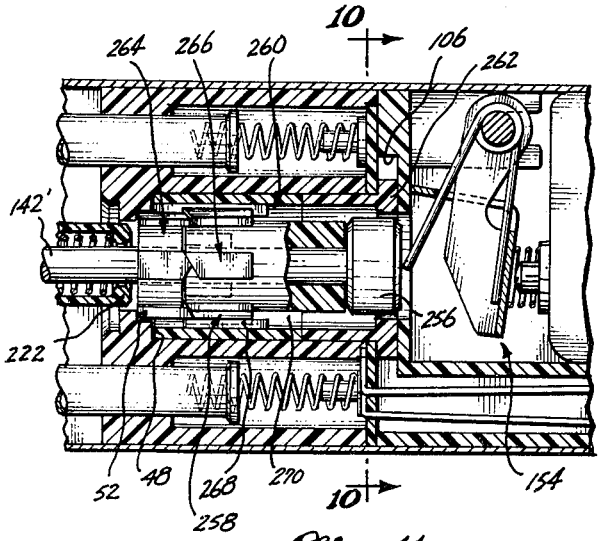
Fig. 11.
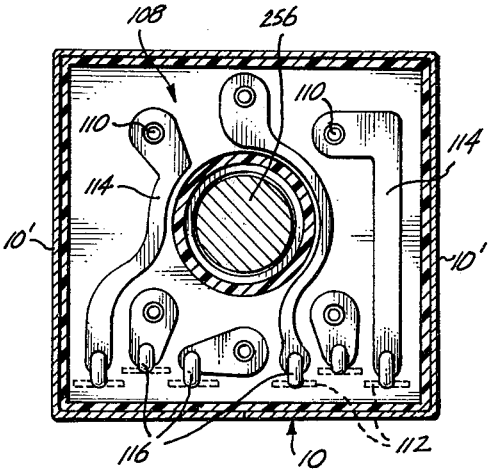
Fig. 10.

ELECTRICAL CARTRIDGE WITH INTERCHANGEABLE CIRCUITRY FOR THE CAP

This is a divisional of application Ser. No. 266,305, filed June 26, 1972.

FIELD OF THE INVENTION

The invention relates to reciprocably engageable assemblies, and in particular to ones which are releasably latched to one another in the engaged condition thereof, and employed as a servomechanism for an operating unit which is disposed to be acutated when the assembly is reciprocated in one direction thereof. The invention also relates to certain features of interchangeability in the assembly, whereby different mechanical and/or electrical effects may be achieved from one change to another.

BACKGROUND OF THE INVENTION INCLUDING CERTAIN OBJECTS THEREOF

Assemblies of this nature are widely used in the electrical industry, particularly in electrical cartridges which are mounted on a panel, either as individual units, or collectively as a keyboard of the same. Each cartridge is equipped with a cap which is slidably guided in the open end thereof to serve as the push-button actuator for a servomechanism which is mounted in the cartridge in advance of an operating unit, such as a switch unit, which is actuated thereby. The cap is usually illuminated to reveal intelligence thereon which is indicative of the nature or condition of the operating unit, and is preferably removable from the cartridge so that the illuminating lamps therein can be replaced when necessary. It is desirable, however, that the cap not be totally detachable from the cartridge, but instead be tethered to the same, so as to assure that it is not separated and lost when it is removed for the relamping operation. It is also desirable that the cap be securely latched to the servomechanism, when it is returned to the cartridge, so that forces acting on the cartridge during normal use and abuse of the same, such as shock forces, will not dislodge the cap and prevent it from being always readily available for the servo-function.

One object of the present invention, therefore, is to provide a mechanism whereby the cap can be releasably latched to the cartridge, when it is inserted therein, and the cartridge can be expected to withstand shock forces of limited duration and extent without the cap becoming dislodged therefrom, yet the latch mechanism can be overridden by a finger pull on the cap when it is necessary or desirable to remove it from the cartridge. Another object is to provide a latch mechanism of this nature whereby the cap can be latched to the servomechanism in the cartridge, and can become a part thereof for purposes of actuating the operating unit in the cartridge. A further object is to provide a latch mechanism of this nature which is adapted to function with any one of several servomechanisms, which may provide among them, for example, a momentary action effect, an alternate action effect, a latch and unlatch effect with respect to other cartridges in a keyboard of the same, or some other similar special effect which is suited to the operation of the unit inboard of the cartridge. A still further object is to provide a mounting base for the servomechanism whereby it can be readily interchanged with another such mechanism, notwithstanding that the same cap is retained and operably latched to the servomechanism as described. Still another object is to provide an intermediate actuator within the servomechanism, which is operable to actuate the operating unit while providing a degree of overtravel for the servomechanism otherwise. An additional object is to provide an electrical contact assembly, and a mounting technique for the same, whereby various electrical arrangements can be achieved in the cartridge, for purposes of illuminating the cap in such a way as to reveal different intelligence, or different combinations of intelligence on the cap. Still another object is to provide a mechanism whereby the cap is tethered to the cartridge, in the removed position thereof, yet can be released from the tether by a few simple steps that are readily executed with one's hands. Still further objects will become apparent from the description of the invention which follows hereafter.

SUMMARY OF THE INVENTION

These objects and advantages are realized by a releasable latch mechanism of my invention which is adapted to cooperate with a relatively reciprocable member, and comprises means defining a stop about the path of reciprocation of the member, and a latch element which is reciprocable in parallel with the member, independently thereof, and yieldably biased in a direction lengthwise of the path of reciprocation of the member, into engagement with the stop, as well as yieldably biased in a direction transverse of the path, to assume a position thereon. The mechanism also comprises detent means which are operable to interengage the latch element and the member, when the member is reciprocated against the bias on the element in the direction transverse of the path; as well as latch release means which are operable to disengage the latch element and the member, when the member is reciprocated against the bias on the latch element in the direction lengthwise of the path.

Preferably, the latch element has a flexible portion thereof which is cantilevered into the path of the member, from a point outside thereof, and which is deflectable by the member, relatively out of the path, when the member is reciprocated in the direction of the bias on the element, lengthwise of the path; but which relaxes into engagement with the member, to reciprocate in conjunction therewith, when the member is reciprocated in the direction opposed to the bias on the element, lengthwise of the path. The latch release means is operable in turn, however, to redeflect the portion of the element, relatively out of the path, after the element has undergone a period of lost motion, in the direction opposed to the bias thereon, lengthwise of the path.

For example, the member may be elongated in the directions of reciprocation, and the flexible portion of the element may take the form of a leaf spring which is cantilevered from a carrier element that is coaxially disposed with the member, about the path of reciprocation thereof, and slidably engageable by the member in the course of reciprocation thereof. The detent means may take the form of a recess in the member, into which the spring relaxes from the deflected condition thereof; and the latch release means may take the form of a bearing surface which is inclined to the path of reciprocation of the member, and slidably engageable with the spring, to deflect the spring relatively out of the recess, after the carrier element has undergone a period of lost motion, in the direction opposed to the bias thereon, lengthwise of the path.

In the presently preferred embodiments of the invention, the member telescopically engages in a socket which has an annular shoulder therein, about the path of the member, and pairs of oppositely disposed ramps therein, which are interposed between the shoulder and the mouth of the socket, on opposite sides of the path, and inclined toward the opening within the shoulder. The carrier element takes the form of a ring which is disposed in the socket, coaxially with the path of the member, and has a pair of codirected leaf springs on diametrically opposite sides thereof, which together with the ring form a U-shaped spring clip within which the member is slidably engageable in the course of reciprocation thereof. The member has a flange thereon, and the tips of the leaves of the clip engage in a circumferential groove in the member, when the flange engages a stop adjacent the mouth of the socket. The leaves have flanges thereon, however, which slidably engage on the ramps, so as to deflect the leaves from one another, when the clip is reciprocated against the bias of a coiled spring which is interposed in the socket, between the ring and a second annular shoulder therein, that is disposed adjacent the mouth of the socket and opposed in orientation to the first mentioned shoulder.

Where the latch mechanism is used in latching a cap to an open-ended cartridge of the type mentioned earlier, the latch element, the stop, and the latch release means are normally incorporated into the cap, whereas the detent means is embodied on a member in the cartridge. The member may take the form of a shaft which is incorporated in a servomechanism for an operating unit which is mounted in the cartridge. Moreover, the shaft may be reciprocable and may have a flange thereon, so that the operating unit can be actuated by unidirectional forces applied to the flange, in the direction of reciprocation of the shaft, relatively inward of the cartridge.

Furthermore, the cartridge may be one of a keyboard of the same, and the keyboard may have a mechanism incorporated therein whereby the force applied to the flange on the shaft of one cartridge, operates to latch the respective servomechanism in the operating position thereof, while simultaneously releasing the servomechanism of another cartridge, from the operating position thereof. Also, in this same connection the shaft in each cartridge may be telescopically engaged with the respective servomechanism therein, and may be yieldably biased in the direction of reciprocation, relatively outward of the cartridge, so that the cap is returned to the normal position thereof, each time a force is applied to the same. In fact, the bias may be applied to the cap itself, since the shaft is latched to the cap.

Alternatively, the cartridge may have a mechanism incorporated therein whereby the force applied to the flange, operates alternately to latch the servomechanism in the operating position thereof, and to release the servomechanism from the operating position thereof. In this same connection, moreover, the alternate action mechanism may be slidably engaged on the shaft, between the flange and the cap, and the cap may be yieldably biased in the direction of reciprocation, relatively outward of the cartridge, so that the cap is shifted between alternate positions relatively inward and outward of the cartridge, when the servomechanism is latched in and released from the operating position thereof. In fact, the bias may be applied to the shaft itself, since the cap is latched to the shaft.

For the details of a latch and unlatch mechanism which may be employed with the servomechanism in a keyboard assembly of two or more cartridges, see U.S. Pat. No. 3,249,705. For the details of an alternate action mechanism which may be employed with the servomechanism, see U.S. Pat. No. 3,402,379.

Preferably, each servomechanism is mounted in a multiblock base in which the blocks are tandemly arranged so that a block can be added to or deleted therefrom for purposes of converting the servomechanism to one effect from another.

In the presently preferred embodiments of the invention, moreover, the servomechanism includes an intermediate acutator which is interposed between the shaft and the operating unit, and operable to actuate the unit while providing a degree of overtravel for the shaft in the operating stroke thereof. The actuator comprises a flap that is pivotally mounted about an axis which is transverse to and spaced from the operating means of the unit, and which is operable against a biasing element which is interposed therebetween. It also comprises a U-shaped spring member which is pivotably mounted about the same axis, and cooperatively engaged with the flap to assume a normally stopped position between the shaft and the flap, whereby the shaft operates the flap, and thus the operating means of the unit, by compressing the legs of the spring member relatively toward one another, to pivot the flap against the bias of the element therebetween.

Once the cap is unlatched from the shaft, it is removable to a position outside of the cartridge. In this position, however, the cap is tethered to the cartridge, so as to remain attached thereto.

In the presently preferred embodiments of the invention, moreover, the tether and the cap are disengageable from one another in the relatively removed position of the cap. The cap has an elongated groove in the base thereof, which opens into a foyer at one end thereof, and the tether comprises a U-shaped member, the legs of which are flexible in relation to one another, and equipped with outturned flanges at the ends thereof which engage in the foyer of the cap, through the opening thereto from the groove. Preferably, the base of the cap is slidably engageable with the open end of the cartridge, the groove is disposed in one of those sidewalls of the base which slidably engage with the cartridge, and the tether is adapted to nest in the groove when the cap is so engaged in the cartridge.

Where the cap is illuminated, the mounting base in the cartridge includes an electrical contact assembly through which the lamps of the caps are energized when the cap is inserted in the cartridge. Preferably, the base is multiblocked and the blocks are tandemly arranged, as indicated, and the assembly includes a printed circuit board which is replaceably clamped between a pair of blocks, and equipped with an array of contact points on the printed face thereof, as well as an array of contact prongs which are attached to the board along one edge thereof, and extend to the rear of the face through the base, in a corresponding number of slits for the same in the base. The cap is electrically interconnected with the contact points, in the inserted condition thereof, and in order to standardize the base, while allowing for variable electrical arrangements in the cap, the board is interchanged for another board having differing circuitry interconnected between the contact points and the points of attachment of the prongs along the one edge thereof.

The cap also has variable partitioning between the lamps thereof, whereby other variations can also be obtained, if desired.

BRIEF DESCRIPTION OF THE DRAWINGS

These features will be better understood by reference to the accompanying drawings which illustrate certain of the preferred embodiments of the invention.

In the drawings,

FIG. 1 is a part schematic, part cutaway perspective view of a keyboard assembly incorporating features of the invention;

FIG. 9 is a part cross-sectional view of the tethering mechanism in the cartridge;

FIG. 10 is a cross-sectional view of the cartridge at the point of the printed circuit board therein; and FIG. 11 is a part cross-sectional view of the cartridge when the servomechanism therein is converted to a different effect.

DESCRIPTION OF THE PREFERRED EMBODIMENTS

Figure 2:
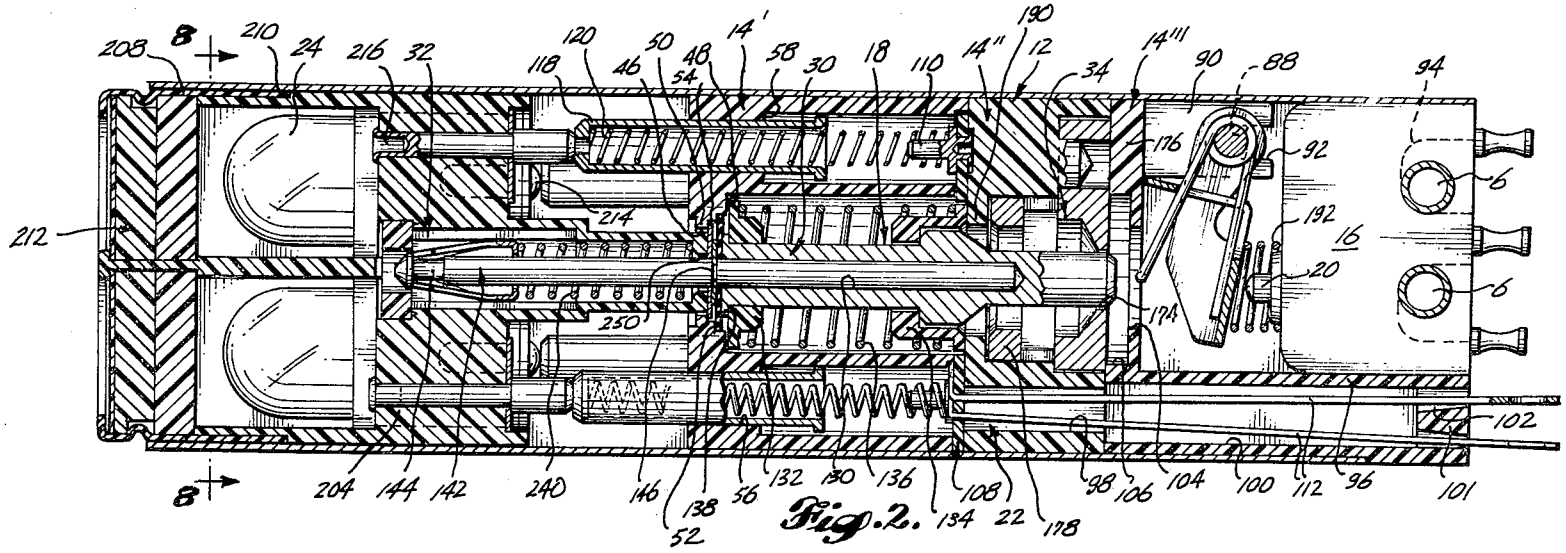
FIG. 2 is a part cross-sectional view of one cartridge in the assembly, with the latch mechanism thereof rotated 45 degrees with respect to its normal condition in FIG. 8, and illustrated in the engaged condition thereof.

Referring firstly to FIGS. 1–10, it will be seen that the keyboard 2 comprises three distinct cartridge units 4 which are assembled in juxtaposition to one another and pinned together crosswise of the assembly by a pair of rods 6 which are passed through a series of transversely aligned holes 8 in the rear end portions of the cartridges. Each cartridge 4 comprises an open-ended tubular metal sheath 10 which is square in cross section and sized to house a mounting base 12 and the various operating components of the unit. The mounting base 12 is assembled from three irregularly sized and shaped, hollow-bore plastic blocks 14′, 14″ and 14‴ which are tandemly inserted and secured within the rear end portion of the sheath 10. The operating components include a triad of transversely-apertured, switch modules 16 which are mounted in the rearmost block 14‴, and a plunger-operated servomechanism 18 which is mounted in the forwardmost and intermediate blocks 14′ and 14″, to actuate the spring-loaded contact buttons 20 of the modules 16. The operating components also include a multi-pronged electrical contact assembly 22 which is mounted in the base 12 to energize the lamps 24 of an illuminated pushbutton cap 26 which is insertable in the forward end portion or vestibule 28 of the sheath 10, for use in operating the switch assembly 16 through the medium of the servomechanism 18. The contact assembly 22 is replaceably structured and mounted so that the lamps 24 can be energized in two or more variable combinations of the same. The cap 26 is releasable from the sheath when desired, as for example, when it is necessary to replace the lamps. In the inserted condition, the cap is telescopically engaged with the plunger 30 of the servomechanism, and is operable to reciprocate the plunger through the actuating stroke thereof, when a force is applied to the cap in the direction relatively inward of the sheath 10. In addition, the cap is releasably latched to the of plunger, so that should the cartridge experience a shock force of limited duration and extent, the force will not separate the cap from the cartridge in the direction relatively outward of the sheath. The mechanism 32 for this purpose, may be overridden however, by a greater force such as a finger pull, when it is desired to release the cap from the cartridge.

In the released condition, the cap is not freed from the cartridge altogether, however, in that the cartridge also includes an elongated tether 33 by which the cap is leashed to the sheath, even after it has assumed a position relatively outside thereof. See FIG. 1. On the other hand, when desired, the tether may be disconnected from the cap, or vice versa, to free the cap from the cartridge, when the cap is in this condition.

The operating components of the respective cartridges also include means whereby the operating stroke of the servomechanism 18 of one cartridge, results in the plunger 30 of that mechanism being latched in the operating position thereof, while the plunger 30 in the servomechansim 18 of one of the other cartridges, is released from the operating position thereof. This effect is produced by a latch and unlatch mechanism 34 which is similar to that disclosed in the aforementioned patent, and which is disposed crosswise of the keyboard, as an operating component which is common to all of the cartridges.

These various components and features will be better understood by the more detailed discussion of the same which follows hereafter.

Figure 3:
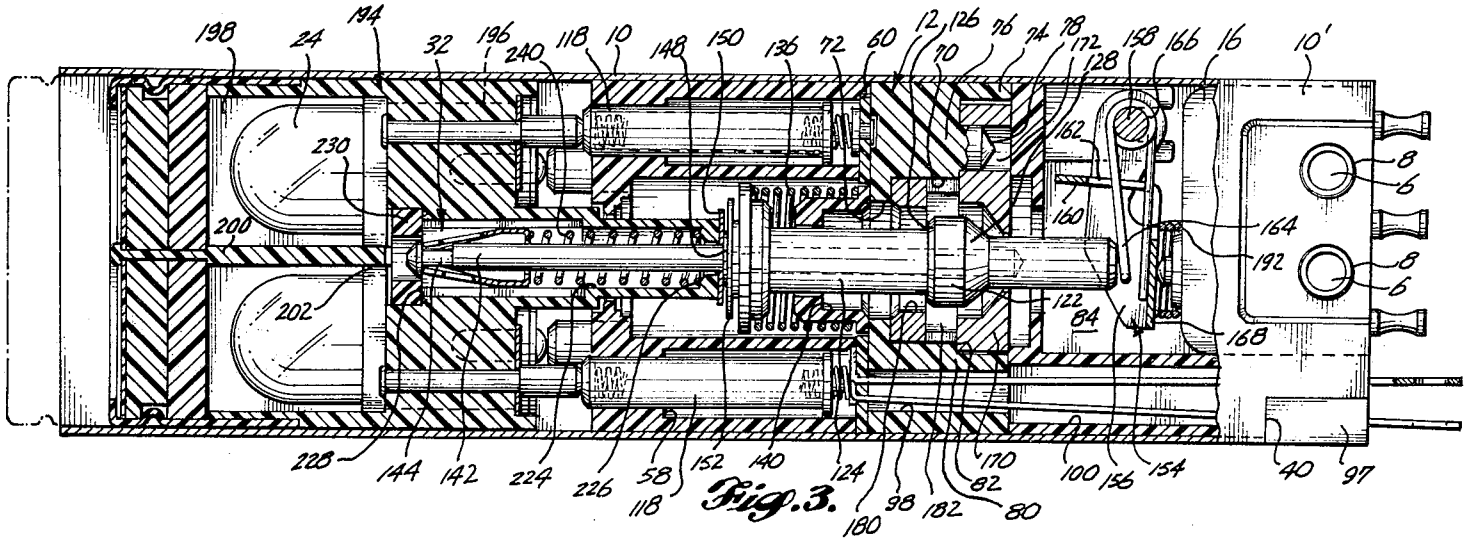
FIG. 3 is another such part cross-sectional view, illustrating the latch mechanism in the disengaged condition thereof.
Figure 8:
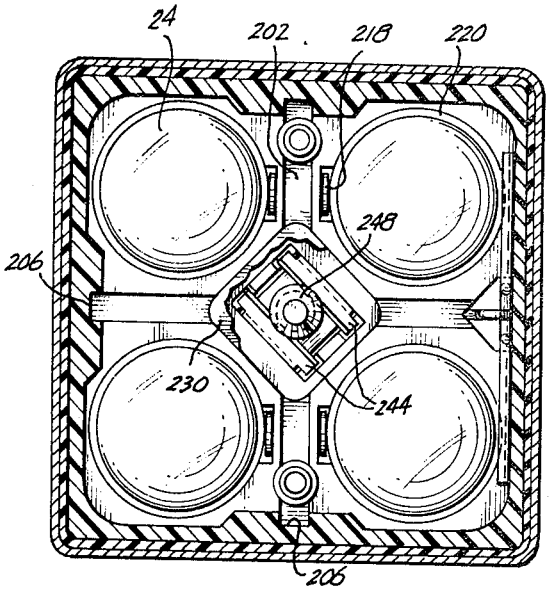
FIG. 8 is a cross-sectional view of the cartridge along the line 8—8 of FIG. 2.
Figure 5:
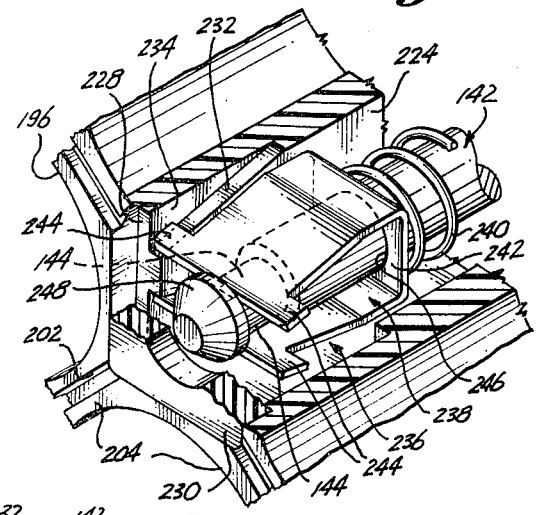
FIG. 5 is a part perspective view of the latch mechanism in this condition.
Figure 4:
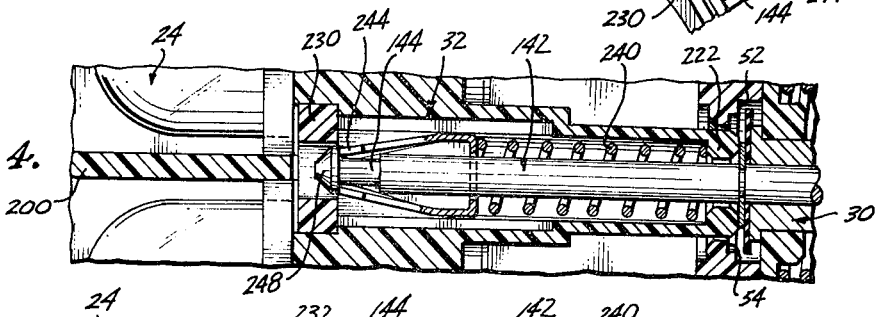
FIG. 4 is a larger-scale, part cross-sectional view of the latch mechanism, when the mechanism is in the engaged condition thereof.
Figure 6:
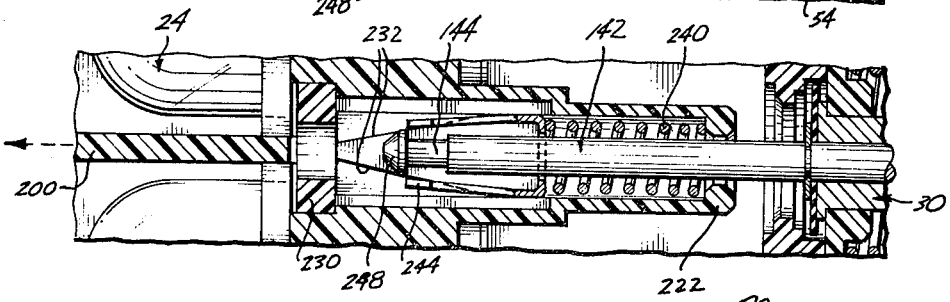
FIG. 6 is a view similar to that of FIG. 4, when the latch mechanism is in the disengaged condition thereof.
Figure 7:
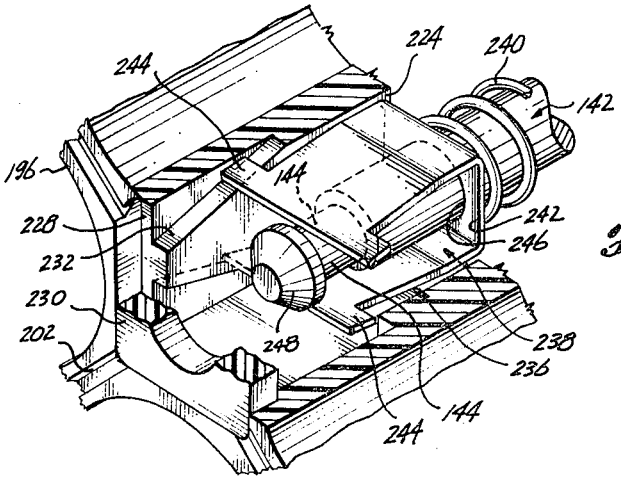
FIG. 7 is a view similar to that of FIG. 5, when the latch mechanism is in the disengaged condition thereof.

Referring firstly to FIGS. 1–3 in particular, it will be seen that the sidewalls 10′ of each sheath have pairs of spaced vertically aligned tabs 36 thereon, which are cut and bent inwardly therefrom, adjacent the longitudinal centers of the same. The righthand sidewall also has a pair of spaced longitudinally aligned staples 38 thereon, that are bent inwardly therefrom, to either side of the pair of tabs 36 thereon. In addition, the lower rear end edge portion of each sheath is removed to form a step 40 on either side thereof, and the holes 8 are provided thereabove, to accommodate the connecting rods 6, as indicated; whereas the latch and unlatch mechanism 34 is accommodated in a larger L-shaped hole 44 which is disposed more forwardly in each sidewall 10′ of each sheath, that is oriented inwardly of the keyboard when the cartridges are assembled.

The bore 46 of the forwardmost mounting block 14′ is deeply counterbored from the rear, and to a lesser extent from the front, to form relatively deeply inset and shallow shoulders 48 and 50, respectively, therein. Moreover, the deeply inset shoulder 48 is rabbetted twice to form to two progressively narrower shoulders 52 and 54 therein. Symmetrically arrayed about the bore 46 are six smaller bores 56, three above and three below, which are also deeply counterbored from the rear to form deeply inset shoulders 58 therein. The rear end face of the block 14' is slightly relieved about the full array of bores 56, yet short of the outline of the block, so as to leave a square-shaped recess 60 in the face, which is surrounded by a raised peripheral rim. And lastly, the forward edges of the right- and left-hand sidewalls of the block, are deeply rabbetted, so as to form shoulders 62 to either side of the block, which abut the tabs 36 in the sheath 10 when the base is inserted therein. The right-hand sidewall also has a deep, longitudinally-extending groove 64 therein, which opens to the front of the block, but terminates short of the rear end face thereof. The groove 64 in turn has a narrower countergroove 66 down the center thereof, which is cut through the terminal wall 68 of the groove 64, to the rear end face of the block.

The intermediate block 14'' is considerably reduced in thickness, longitudinally of the sheath, and has a deeply removed foyer 70 formed in the rear end face thereof, which opens to the front through the bore 72 therein, and is overhung by a corbeled mantel 74, the corbel 76 of which has a pair of spaced, rearwardly-directed indexing buttons 78 outstanding thereon. The deck 80 of the foyer is slotted, and in addition, has a step 82 thereon coincident with the face of the corbel 76.

The rearmost block 14''' has the greatest longitudinal extent, although like the intermediate block 14'', most of it is removed, in this instance to form a deeply inset vestibule 84 in the rear end thereof, the sidewalls of which have transversely aligned holes 88 in the upper front corners of the same, the insides of which corners have lands 90 formed thereon, which are slotted at the rear edges thereof, the slots 92 terminating in coincidence with the holes 88. The sidewalls of the vestibule also have pairs of notches 94 in the rear edges thereof, and the deck 96 of the vestibule has right angular shoulders 97 outstanding on the lower rear end edge portion thereof, and is slotted to register with the slots 98 in the intermediate block 14'', although in the case of the rearmost block, the slots 100 terminate short of the rear end face thereof, to form a grated end wall 101 having six horizontally disposed slits 102 therein. The vestibule 84 opens to the front of the block through the bore 104 therein, which has a countersink 106 formed thereabout, in the front face of the block.

The contact assembly 22 comprises a centrally apertured printed circuit board 108 which has an array of contact studs 110 outstanding thereon, corresponding in location to the array of bores 56 in the forwardmost mounting block 14'. An equal number of L-shaped, end-apertured prongs 112 is soldered to the lower edge portion of the board, to extend on perpendiculars to the rear of the board at sufficient length to pass through and beyond the slots 98 and 100, and the grated end wall 101 of the base. The circuitry 114 of the board is interposed between the studs 110 and the solder connections 116 of the prongs 112, and may be interconnected in various arrangements from one cartridge to another, depending on such considerations as the number and arrangement of lamps in the caps, and the number of commons among the prongs from one contact assembly to another. In each cartridge, the printed circuit board 108 is clamped between the forwardmost and intermediate blocks 14' and 14'', and is housed within the recess 60 in the rear end face of the forwardmost block, with the prongs 112 thereof extending rearwardly through the slots 98 and 100, and then the grated end wall 101 of the base. Contact is made between the lamps 24 of the cap and the studs 110 of the printed circuit board, through the medium of six hollow, flanged, spring-loaded contact posts 118 which are carried in the bores 56 of the forwardmost block, and loaded in the forward direction, against the shoulders 58, under the bias of an equal number of coiled springs 120 which are caged within the posts about the studs 110.

Midway the length of the plunger 30 of the servomechanism 18, there is a thick radial flange 122 on the shank 124 of the same, the forward end face 126 of which is chamfered in a sharp taper, and the rear end face 128 of which is chamfered in a more gentle taper. The plunger 30 also has a deeply inset bore 130 in the forward end thereof, and is equipped with a pair of retainer rings 132 and 134 which are slidably engaged on the forward end portion of the shank 124, with a coiled spring 136 caged therebetween. The opposing faces of the rings are rabbetted to form shoulders for seating the spring, and the more forwardly disposed ring 132 is retained on the plunger by peening over the tip 138 of the same, whereas the more rearwarly disposed ring 134 abuts the sharply tapered end face 126 of the flange 122 on the plunger, after the flange 122 is received in a recess 140 counterbored in the rear end face of the ring 134.

Telescoped in the bore 130 of the plunger is an elongated shaft 142 which has a wide circumferential groove 144 in the tipped forward end portion thereof, and a narrow circumferential groove 146 in the waist portion thereof. A E-shaped open-sided retainer clip 148 is engaged in the narrower groove 146, and an elastromeric washer 150 and a metal washer 152, are slipped over the rear end forward end portions of the shaft, respectively, in abutment with the clip 148.

The servomechanism 18 also comprises an intermediate, flap-like actuator 154, which is interposed between the plunger 30 and the switch modules 16, to operate the buttons 20 of the modules under the impetus of the plunger, and at the same time to provide for a degree of overtravel on the part of the plunger in the operating stroke. The actutor 154 consists of a yoke-like sheet metal flap 156 which is pivoted to a trunnion pin 158 and has an L-shaped extension 160 thereon, in which there is a slot 162 to receive a U-shaped loop 164 formed in a coiled spring 166 which is doublewound about the pin 158, to either side of the loop 164, and restrained under tension by engaging its ends against the transom 168 of the flap.

Consistent with the disclosure of U.S. Pat. No. 3,249,705 the latch and unlatch mechanism 34 for the plunger comprises an elongated backup plate 170 which is adapted to extend the full width of the keyboard, and has sets of upper and lower transversely aligned holes 172 and 174 therethrough, the lower 172 of which are countersunk and chamfered at the forward ends thereof, and the upper 174 of which are disposed in pairs to either side of the lower holes 172, and adapted to mate with the buttons 78 on the intermediate block, for purposes of fixing the plate 170 in the foyer 70 of the block, between the step 82 and the corbel 76 of the block, and the bulkhead 176 of the rearmost block 14'''. The latch and unlatch mechanism 34 also comprises a spring-loaded latch plate 178 which corresponds to that seen at 30 in FIG. 5 of the patent, and which is characterized with holes 180 at spaced intervals that are oversized with respect to the flange 122 of the plunger, to function in the manner of the holes 30*b* in the patent. Interposed between the two plates 170 and 178, is a pair of end-notched lockout plates 182, the end notches of which are V-shaped in cross section and sized to cooperate with the flange 122 on the plunger, in the manner of the plates 26 and 28 in the patent, there being a plate 182 to either side of the plunger, as in the patent.

The tethering mechanism 33 comprises a length of wire 184 which is stepped at the middle, and reentrantly bent at either end, to form a retainer loop for another length of wire 186 which is hooked thereabout within the cartridge. The latter piece of wire 186 is essentially U-shaped in configuration, and has outturned feet 188 on the ends thereof, for engaging the wire 186 on the cap, as shall be explained.

In assembling the cartridge, the mounting base 12 is inserted in the rear end portion of the sheath until the shoulders 62 of the forwardmost block abut the tabs on the sideswalls 10' of the sheath, and the shoulders 97 of the rearmost block engage in the steps 40 at the rear of the sheath. Then the sidewalls 10' are pinched in, about the holes 8, in preparation for the rods 6 being added to the same through the notches 94, as the keyboard is assembled from the three cartridges. Prior to insertion of the base, however, the contact posts 118 are loaded into the bores 56 of the forwardmost block, and the circuit board 108 is interposed between the forwardmost and intermediate blocks, with the springs 120 of the posts surrounding the studs 110 of the board, and with the prongs 112 of the board projecting to the rear through the slots 98 and 100, and the grated end wall 101 of the base. Also, the reentrant tips of the tethering loop 184 are engaged in the staples 38 of the sheath, and as the base is added, the body of the loop 184 is engaged in the countergroove 66 of the block 14', with the tethering wire 186 retained thereon. The plunger 30 is slidably engaged in the bore 46, 72, 104 of the base, and the clip and washer assembly 148, 150, 152 on the shaft 142 of the same, is nested in the recess defined by the progressively narrower shoulders 52 and 54 of the forwardmost block, so as to restrain the shaft against movement in both the sidewise and forward directions thereof. Moreover, the rings 132 and 134 on the shank 124 of the plunger are interposed between the surrounding shoulder 48 of the bore 46, and the bulkhead 190 of the intermediate block 14'', to provide the necessary loading on the plunger. Meanwhile, the flanged rear end portion of the plunger is extended into and through the foyer 70 of the intermediate block, and the plates 170, 178 and 182 of the latch and unlatching assembly are arranged transversely thereof, from cartridge to cartridge, through the openings 44 in the sheathes. See FIG. 1. Also, the trunnion pin 158 of the flap actuator is inserted through the slots 92 in the lands 90 on the sidewalls of the rearmost block, and is engaged in the holes 88; after which the switch modules 16 are inserted behind the actuator, and are pinned to the cartridge in the vestibule 84 of the block, and a coiled spring 192 engaged about each of the buttons 20 of the same, to bias the actuator into the stopped position of FIG. 2.

The cap 26 has a hollow base 194 which is essentially square-shaped in outline, though chamfered at the corners, and which is sized to be slidably received in the vestibule 28 of the cartridge. The rear end of the base has a spider-like cross section, providing four symmetrically arrayed sockets 196 for the lamps 24 of the cap. The lamps are inserted into the sockets from the rear, and project into a foyer 198 at the front of the cap. The foyer is selectively partitioned by one or more plate-like dividers 200, which are slidably engaged in grooves 202 in the forward end edges of the webbing 204 of the spider, as well as in grooves 206 in the bottom and sidewalls of the foyer 198. The foyer is also defined in part by a square-shaped ferrule 208 which is engaged and secured about the forward end portion of the base, in a rabbet 210 adapted to receive the same, and which has a set of lenses 212 therein, that present color-backgrounded intelligence to viewers of the cap, the intelligence being coordinated with the combination of lamps in use therebehind, due to the presence of the dividers 200 between the lamps.

When the cap is inserted in the vestibule 28 of the cartridge, the posts 118' at the four corners of the array of bores 56 in the base 12, contact the buttons 214 of the lamps. The two remaining posts 118'' contact a pair of metal studs 216 which are fixed on the vertical webbing 204 of the spider, and which are equipped with bent-over tee flanges 218, the bent-over arms of which make contact with the shells 220 of the lamps, to ground the same through the posts 118''.

The cap 26 is also equipped with other features which relate to the latching and tethering of the same in the cartridge. The body of the spider projects to the rear of the base 194, at the confluence of the webbing 204, and a stepped embossment 222 is formed thereon, the bore 224 of which opens to the front through the spider. The bore 224 is counterbored from the front, moreover, to form a deeply inset shoulder 226 therein, adjacent the tip of the embossment; and there is also a square-sectioned countersink 228 at the front of the bore 224, which forms a seat for a square-outlined washer 230 that is bonded or otherwise secured in the countersink 228 behind the dividers 200. To the rear of the washer, that is, between the seat 228 and the shoulder 226, the bore 224 is enlarged to an intermediate depth, in the same section as the washer, and pairs of oppositely disposed ramps 232 are formed on oppositely disposed walls 234 of the enlargement 236, with inclines that taper relatively toward the countersink 228, and inwardly of the bore 224. See FIGS. 5 and 7. The ramps 232 provide caming surfaces for an apertured U-shaped spring clip 238 which is loaded within the bore 224 behind the washer 230, and biased into engagement with the washer, by a coiled spring 240 which is interposed between the apertured bight portion 242 of the clip and the shoulder 226 of the bore The leaves of the clip 238 are oriented crosswise of the ramps 232 and have laterally projecting flanges 244 at the tips thereof, which are adapted to ride on the ramps, to either side of the clip.

When the cap is inserted in the vestibule 28 of the cartridge, the shaft 142 of the plunger telescopes within the bore 224 of the cap. The spring 240 and the aperture 246 in the bight portion 242 of the clip, are sized to enable the shaft to pass therethrough, and the washer 230 is also sized to receive the head 248 of the shaft. But the gap between the tips 244 of the clip, is undersized with respect to the shaft, so that when the head 248 of the shaft enters the bore 224 through the mouth 250 thereof, it readily penetrates the spring 240 and the clip 238, but in reaching the washer 230 separates the tips 244, until the tips coincide with the groove 144 at the rear of the head 248. At this point the tips snap into engagement with the groove, and latch the cap 26 to the shaft 142 when they are abutted against the head 248 at the forward end of the groove 144, under the bias of the spring 240. The bias is sufficient, moreover, to withstand shocks of the magnitude which the cartridge may be expected to experience in periods of normal use and abuse.

On the other hand, when desired, the cap may be released from the shaft 142 by overcoming the bias of the spring 240, such as with a finger pull outward of the cartridge. In such a case, the cap undergoes displacement relative to the shaft, and the ramps 232 cause the flanged tips 244 of the clip to separate, as the ramps undergo displacement forwardly of the cartridge. Ultimately, after a short period of lost motion, the tips are disengaged from the groove 144, and the cap is freed from the shaft 142, and vice versa, for release from the cartridge to the position of FIG. 1. At the same time, the spring 240 reengages the clip with the washer 230, so that the cycle can be repeated when the cap is returned to the vestibule 28 of the cartridge.

Looking again to FIG. 1, it will be seen that the base 194 of the cap also has an inset V-sectioned groove 252 in the near sidewall thereof, that is, in the sidewall thereof corresponding to the side of the sheath on which the tether 33 is located. The groove 252 extends forwardly from the rear end of the base, and terminates at a point coinciding with the forwardly oriented face of the spider, so as to open into the foyer 198 of the cap. The tethering wire 186 is attached to the cap by orienting the feet 188 of the same lengthwise of the groove 252, inserting the foot on one leg of the wire into the foyer through the opening 254 thereto and thereafter flexing the other leg crosswise of the first leg, until the foot 188 of it is juxtaposed with the foot of the first leg, and the wire and the cap can be engaged by swivelling one in relation to the other, to enable the foot of this other leg to enter the opening 254 as it returns to its normal position under the flexure inherent in the wire.

To disengage the two, the process is reversed.

FIG. 11 illustrates the manner in which the cartridge may be modified to serve as an alternate action device of the type shown in U.S. Pat. No. 3,402,379. The intermediate block 14'' of the mounting base 12 is eliminated, as is the plunger 30 and the clip and ring assembly 148, 150, 152 on the shaft 142 of the servomechanism. Instead, the shaft 142' (FIG. 11) is modified to carry a circumferential enlargement 256 on the rear end thereof, and a jaw clutch mechanism 258 such as that seen in FIG. 3 of the patent, is slidably engaged on the shaft 142', between the enlargement 256 and the shoulders 48, 52, 54 of the forwardmost block. Also, the female clutch member 260 has an outturned flange 262 on the rear end thereof, which is interengaged between the forwardmost and rearmost blocks 14' and 14''' in the countersink 106 of the latter block. The clutch release member is seen at 264, and operates on the male clutch member 266, alternately to actuate and release the intermediate mechanism 154 which corresponds to the caged spring unit 46 in the patent.

The alternate action device of FIG. 11 can be converted into a momentary action device, simply by eliminating the fillet portions 268 between the ribs 270 of the female member 260 so that the device returns to the normal position on each push of the cap. In this way, for manufacturing purposes, only the mold of the female member 260 needs to be changed.

What is claimed is:

1. In combination, an open ended cartridge having an illuminated cap reciprocably received ih the open end thereof, and a mounting base enclosed therewithin, including an electrical contact assembly through which the lamps of the cap are energized, which base comprises a plurality of tandemly-arranged blocks, and which assembly includes a printed circuit board that is replaceably clamped between a pair of such blocks, and equipped with an array of contact points on the printed face thereof, as well as an array of contact prongs that are attached to the board along one edge thereof, and extend to the rear of the face through the base, in a corresponding number of apertures for the same in the base.

2. The combination according to claim 1 wherein the cap has a variable partitioning between the lamps thereof.

3. A method of varying the electrical arrangement of an illuminated cap in an electrical cartridge, comprising structuring the cartridge so that the lamps of the cap are energized through an electrical contact assembly including a printed circuit board that is replaceably secured in the cartridge, and equipped with an array of contact points on the printed face thereof, as well as an array of contact points along one edge thereof, and interchanging the circuit board for another such board having different circuitry interconnected between the contact points on the face and the contact points along the one edge of the board.

* * * * *